US007600576B2

(12) United States Patent
Gayer

(10) Patent No.: US 7,600,576 B2
(45) Date of Patent: Oct. 13, 2009

(54) ROAD-DRAG

(76) Inventor: Daryl Gayer, 2738 N. Shell Rd., City of Olney, Richland County, IL (US) 62450

( * ) Notice: Subject to any disclaimer, the term of this patent is extended or adjusted under 35 U.S.C. 154(b) by 0 days.

(21) Appl. No.: 11/809,570

(22) Filed: Jun. 1, 2007

(65) Prior Publication Data

US 2008/0296033 A1 Dec. 4, 2008

(51) Int. Cl.
*E02F 3/76* (2006.01)

(52) U.S. Cl. ..... 172/799.5; 172/684.5

(58) Field of Classification Search ..... 172/26.5, 172/63, 72, 197, 199, 342, 786, 787, 799.5, 172/445.1, 445.2, 146, 157, 193, 684.5; 37/268, 37/269

See application file for complete search history.

(56) References Cited

U.S. PATENT DOCUMENTS 1,670,265 A * 5/1928 Leedom ..... 172/784
1,756,329 A * 4/1930 Andrew ..... 172/799.5
1,807,639 A * 6/1931 Stocker ..... 172/799.5
1,833,878 A * 11/1931 Adams ..... 172/199
2,142,262 A * 1/1939 Beckham et al. ..... 404/96
2,787,846 A * 4/1957 Everds et al. ..... 172/784
3,172,218 A * 3/1965 Constantin ..... 172/780
3,348,323 A * 10/1967 Purdy ..... 172/780
3,506,074 A * 4/1970 Abbott ..... 172/780
5,330,287 A * 7/1994 Constantin ..... 404/90
6,904,979 B1 * 6/2005 Confoey ..... 172/799.5

* cited by examiner

*Primary Examiner*—Robert E Pezzuto
*Assistant Examiner*—Matthew D Troutman
(74) *Attorney, Agent, or Firm*—Gary K. Price

(57) ABSTRACT

A road drag for medium and heavy grading projects is provided. The road drag includes a pair of side members and front, center and rear transverse bars that define a rectangular shaped platform. A V-member is disposed adjacent each corner of the platform and steel blades are attached to a first arm of each of the V-members in a downward direction. A center V-member is further attached to the center bar. Steel blades are further attached to ends of the center V-member in a downward direction. A tail board is secured to a pair of extensions that extend from the rear bar of the platform that defines a rear section. The rear section includes means to prevent the tail board from bouncing or hopping during application in order to better distribute material during use. The road drag further includes an axle and preferably dual wheels near or adjacent the tail board. The road drag further includes a front end that extends from the front bar of the platform with attaching means that is hitched to the back of a vehicle. The front end preferably includes a leveling means to raise and lower the platform for transport and work applications.

19 Claims, 6 Drawing Sheets

ROAD-DRAG

CROSS REFERENCES TO RELATED APPLICATIONS

None.

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates to road drags and more particular to a device of this character which is strong, durable, easy to manufacture and operate while at the same time efficient in grading surfaces of roads and the like.

2. Brief Description of Prior Art

The typical road drag includes a generally rigid, V-shaped frame having at least one steel blade for scraping the surface and directing loose rock and debris to an opening located at the edge or side of the apparatus. The road drag can further include an auxiliary drag having a plurality of teeth that breaks up lumps of materials. The road drags of the prior art generally have limited, if any provisions for adjusting to various work positions, and generally have no provisions for transport which as a result makes transporting from one job site to another very inconvenient and difficult.

As will be seen from the subsequent description, improvements are needed in road drag technology. There is a need for a road drag that overcomes the deficiencies of the prior art devices and that includes multiple positioning points to adjust for different work sites, can be disassembled for transporting, while at the same time is of heavy construction. As will be described, the preferred embodiments of the present invention overcome disadvantages of the prior art.

SUMMARY OF THE INVENTION

In accordance with the present invention, a road drag for medium and heavy grading projects is provided. The road drag includes a pair of side members and front, center and rear transverse bars that define a rectangular-shaped platform. A V-member is disposed at each front corner of the platform where the front transverse bar intersect the side members such that a first arm of the V-member is in communication with the underside of the side member and intersects with the front transverse bar in a forward, towards the front of the road drag direction. A second arm of the V-member extends from the first arm and attaches to the side member. The first arm defines a 90 degree angle in relation to the second arm. Steel blades are attached to each of the first arms of each of the V-members in a downward direction. A center V-member is further attached to the center bar. Steel blades are attached to arms of the center V-member in a downward direction. A tail board is secured to a pair of extensions that extend from the rear bar of the platform that defines a rear section. The rear section includes means to prevent the tail board from bouncing or hopping during application in order to better distribute material during use. The road drag further includes an axle and preferably dual wheels near or adjacent the tail board. The road drag further includes a front end that extends from the front bar of the platform with attaching means that is hitched to the back of a vehicle. In addition, the road drag preferably includes a leveling means to raise and lower the platform for transport and work applications.

DESCRIPTION OF THE PREFERRED EMBODIMENT

Figure 1:
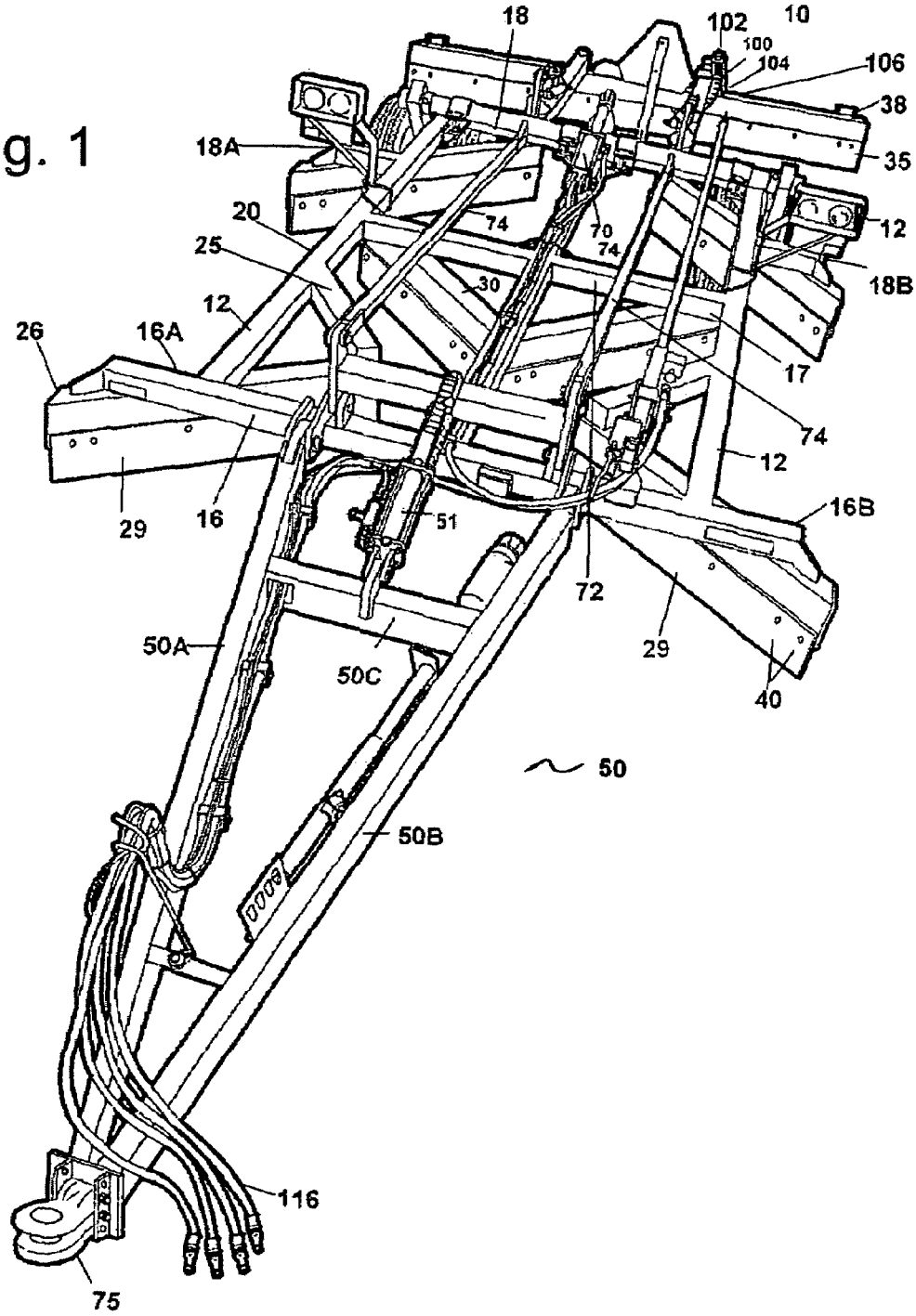
FIG. 1 is a side perspective view of a preferred embodiment of the present invention, a road drag.

In accordance with the present invention, a road drag is disclosed. The road drag is directed to an apparatus for medium and heavy grading projects. Specifically, it will be noted in the drawings that the road drag of the present invention provides an apparatus having multiple positioning points to adjust for different work sites, can be disassembled for transporting, while at the same time is of heavy construction. In the broadest context, the road drag of the present invention consists of components configured and correlated with respect to each other so as to attain the desired objective.

FIG. 1 illustrates a preferred embodiment of a road drag 10 made in accordance with the present invention. The road drag 10 may be described as having a pair of side members 12 which are connected together by front, center and rear transverse bars 16, 17 and 18 respectively. As shown, the front bar 16 is longer than the center bar 17 so that bar 16 extends beyond the side members 12 defining front extension portions 16A, 16B. The side members 12 and transverse bars 16, 17, 18 defining a generally rectangular-shaped platform designated as numeral 20. The platform 20 further includes rear extension portions 18A, 18B that extend parallel with the front extension portions 16A, 16B. The rear extension portions 18A, 18B are adjacent to the rear bar 18.

The side members 12 and the transverse bars 16, 17, 18 each preferably have a square cross-section of somewhat uniform shape throughout its respective length. In addition, the bars 16, 17, 18 are preferably attached to the side members 12 by welding. However, other attaching means, such as bolts or the like, can be employed as well.

The platform 20 has an upper surface 22 and a lower surface 24. Details of the platform 20 are given in FIG. 2.

As illustrated in FIG. 1, steel blades 29 are releasably attached to each of the first arms 26 of each of the V-members 25 in a downward direction. The release can be bolts 40, for example.

A center V-member 30 is further attached to the center bar 17 at ends 30A, 30B. The end 30A defines a second angle designated "A2" (see FIG. 2) in relation to the end 30B. In the preferred embodiment, the angle "A2" is 90 degrees.

Steel blades 29 are releasably attached to each of the ends 30A, 30B (FIG. 2) of the center V-member 30 in a downward direction.

The tail board 35 is secured to a pair of extensions 36 (see FIG. 6) that extend from the rear bar 18 of the platform 20 that defines a rear section generally designated numeral 38.

The road drag 10 further includes means for adjusting the heights of the above-referenced blades 29 in relation to the ground to control cutting depth of the drag 10. Further, lifting the blades 29 allows for better transport of the drag unit 10 and allows the user greater ability to maneuver the drag 10 in tight areas.

As illustrated, the road drag further includes an axle 40 and preferably dual wheels 45 near or adjacent the tail board 35. In the preferred embodiment the axle 40 is a single tube axle. The road drag 10 further includes a front end 50 that extends from the front bar 16 of the platform 20 with attaching hitch 75 that is hitched to the back of a vehicle 100. In the preferred embodiment, the front end 50 is a dual beam design having first and second beam members 50A, 50B and a cross member 500 therebetween to allow for more strength of the pull point. In addition, the road drag 10 preferably includes a leveling means such as a cylinder 70 to raise and lower the platform 20 for transport and work applications, and turnbuckle 442 which preferably is a manual leveling adjustment. In the preferred embodiment the leveling means is a cylinder known in the art attached to the rear end of the platform 20. The road drag 10 further includes linkage members 74 for leveling the front of the drag 10 in relation to the rear.

The road drag 10 is further constructed with multiple pivot points (such as 436 and 440 in FIG. 5) that are replaceable pins. Such pivot points can be selectively disposed in the axle 40, and in the tail board 35. The pivot point design allows for longer life and serviceability of the drag 10 and ease of adjustment.

Figure 2:
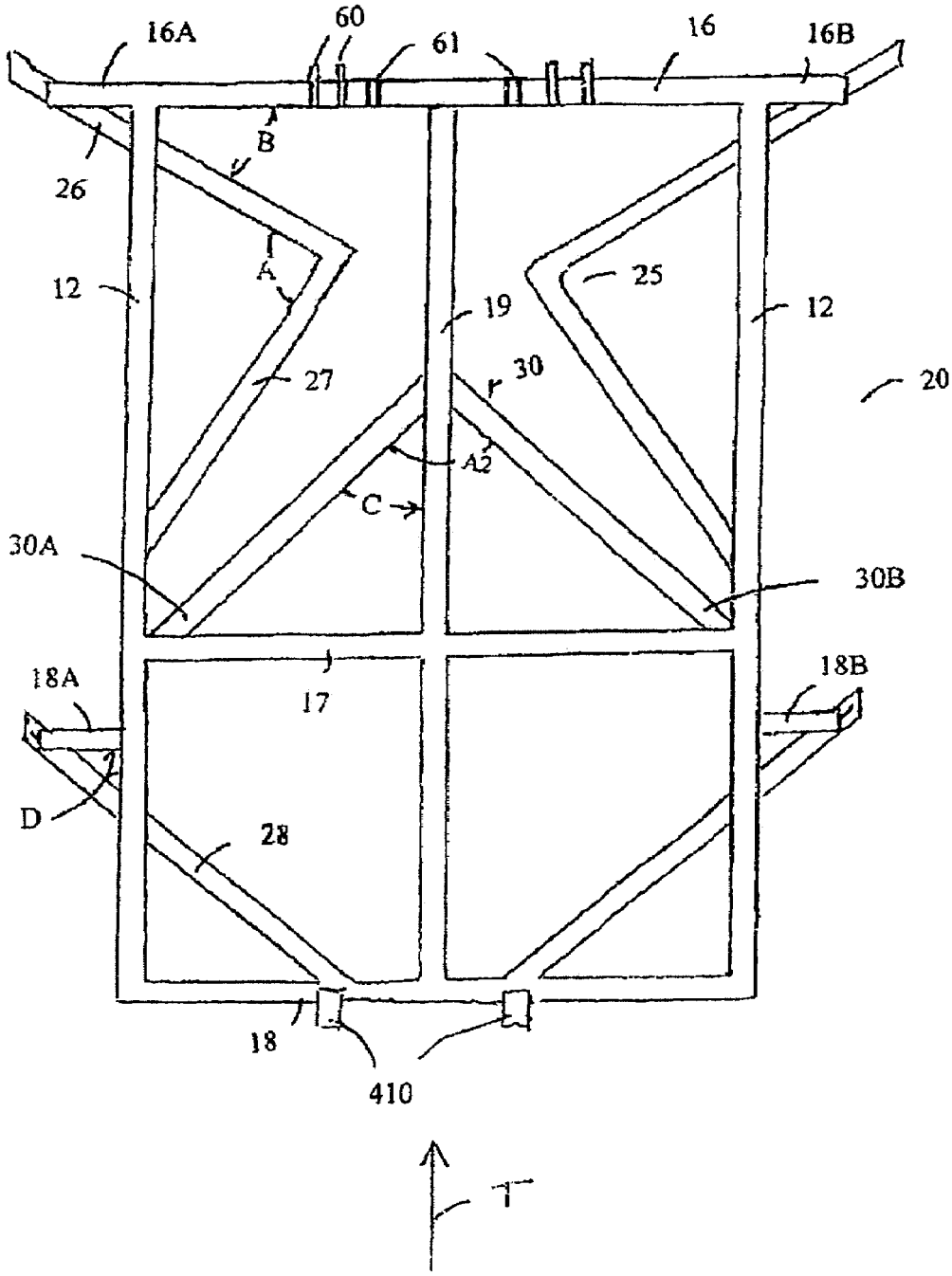
FIG. 2 is a detail view of the platform of the road drag.

FIG. 2 shows details of the platform 20. The platform includes in particular, a V-member 25 disposed at each front corner of the platform 20. More particularly, the V-member 25 is disposed such that a first arm 26 of the V-member 25 is in communication with the underside of the side member 12 and intersects with and extends past the front extension portion 16A and 16B in a forward, towards the front of the road drag 10, direction as will be further discussed. A support 27 extends from the first arm 26 and attaches to the side member 12. As shown, the first arm 26 defines an angle designated "A" in relation to the support 27. In the preferred embodiment, the angle "A" is 90 degrees. Further, the first arm 26 as described is disposed at an angle in relation to the side member 12 as well as the front bar 16.

As stated, a V-member 25 is disposed at each front corner of the platform 20 in communication with the extension portions 16A, 16B, a similar arrangement is provided at the rear of platform 20 with two arms 28 attached to the rear bar 18 and to each of the extension portions 18A, 18B. The above description described the V-member 25 positioned at one of the front corners of the platform 20 in communication with extension portion 16B. It should be understood that as illustrated, each V-member 25 is similarly disposed at each of the remaining corners (extension portions) of the platform 20.

Figure 4:
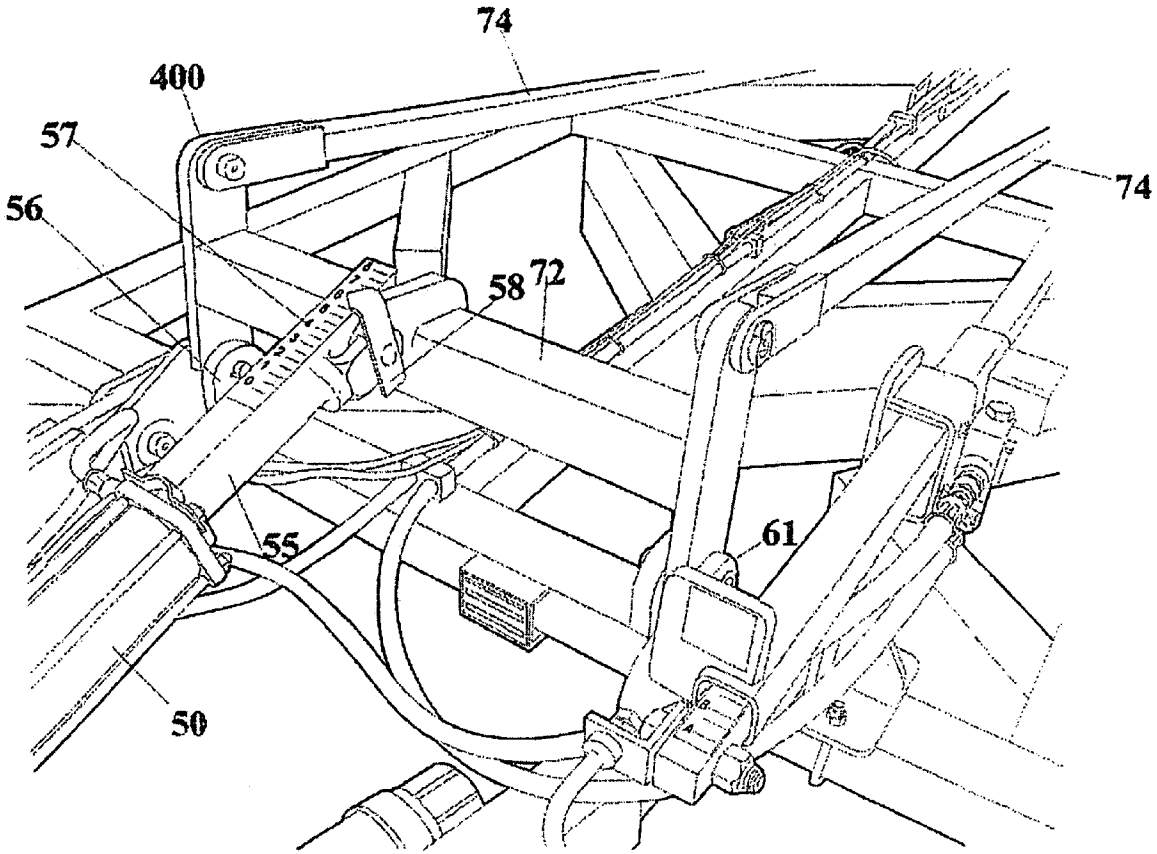
FIG. 4 is a partial view of the road drag.

A center V-member 30 is further attached to the center bar 17 at ends 30A, 30B and to a middle bar 19. The end 30A defines a second angle designated "A2" in relation to the end 30B. In the preferred embodiment the angle "A2" is 90 degrees. The front bar 16 includes attachment points 60 that pivotably attach the front end 50 and also the pivot attachment point 61. FIG. 4 also shows pivot brackets 110. Arms 36 and shock absorbers 39 are pivotably mounted to these pivot brackets 110.

The design and configuration of the steel blades 29 described is to pull material in during application and then move the material out, and then pull material back in, and then leveling. In the preferred embodiment, the front or first row of steel blades (blades 29 attached to the first arms 26 adjacent the front transverse bar 16 of the road drag 10) are disposed at an approximate 45 degree angle "B" with an approximate twenty inch clearance between the first row of steel blades 29 and the center or second row of steel blades (blades 29 attached to the ends 30A, 30B). The second row of steel blades 29 are disposed at an approximate 45 degree angle "C" with an approximate twenty-four inch clearance between the second row of steel blades 29 and approximate twenty-four inch clearance between the second row of steel blades 29 and the third row of steel blades (blades 29 attached to the arms 26 adjacent the rear transverse bar 18). The third row of steel blades 29 are disposed at an approximate 47 degree angle 'D' with an approximate five foot distance between the third row of steel blades 29 and a fourth row 29 disposed at a tail board 35 of the road drag 10. The fourth row of steel blades can be selectively positioned during application.

The line "T" in FIG. 2 shows the normal direction of travel of the road drag 10 and platform 20. Each blade 29 mounting arm 26, 30 and 28 is supportingly attached to the platform 20 at least at each end to resist force applied to the arm 26, 28 and 30 by the blade 29 mounted thereon.

Figure 3:
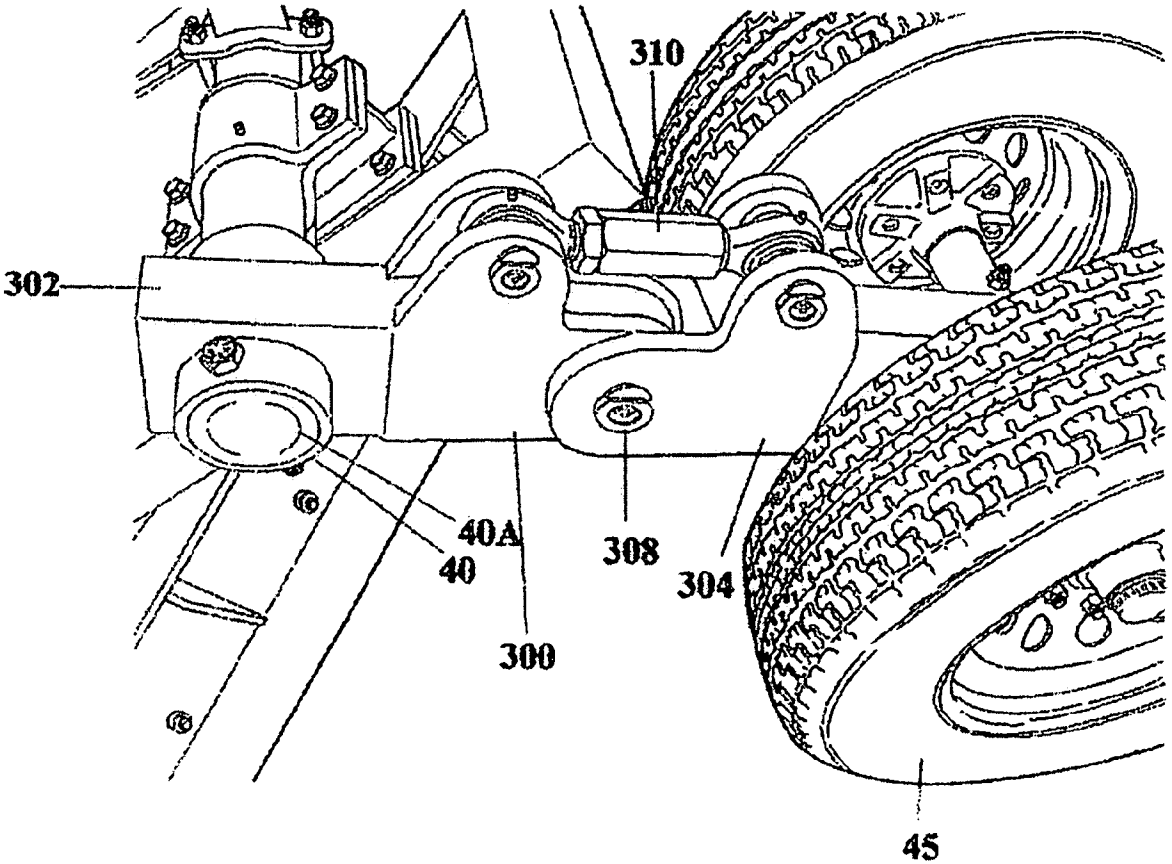
FIG. 3 is a side perspective view of a portion of the road drag of FIG. 1.

Extension bars 74 transfer motion from the front pivot frame 72 to the axle tube 40. As best seen in FIG. 3, rotation of the axle tube 40 will cause rotation of arm 300 to move dual tires 45 about the axle 40. Drawing the dual tires 45 toward the front of the platform 20 will cause the platform 20 to raise. Thus cylinder 70 can move the platform 20 between a first low position where it is ready for use and a second raised position where it is ready for transport. The cylinder 70 also provides adjustment between these two extreme positions. FIG. 3 shows that the road drag 10 can include light brackets 112. Cylinders 51 and 70 can be hydraulic cylinders and can use power from a tractor through hydraulic lines 116.

FIG. 3 shows details of one of the dual wheels 45 and how the wheel is adjustably mounted. Rotation of the axle 40 as shown by arrow 40A will cause the arm 300 to rotate between the axle 40 causing the platform 20 to raise and lower. The arm 300 can include two segments, an upper segment 302 and a lower segment 304 rotatably connected by pin 308. The connection between upper segment 302 and lower segment 304 further includes a turnbuckle 310 that allows for manual adjustment of the angle between the upper and lower segments 302, 304.

FIG. 4 shows details of the platform lift 400 which includes the cylinder 51. Movement of the cylinder 51 shaft 55 causes rotation of the lift bar 72 above the pivots 61 mounted to forward bar 16 of the platform 20. As the lift bar 72 rotates, the arms 74, which are pivotably mounted to arm 72, move longitudinally causing rotation of the axle 40 shown in FIG. 5. The cylinder 51 can include a depth indicator 56 that can include a scale 57 and pointer 58 indicating a depth of blades 29.

Figure 5:
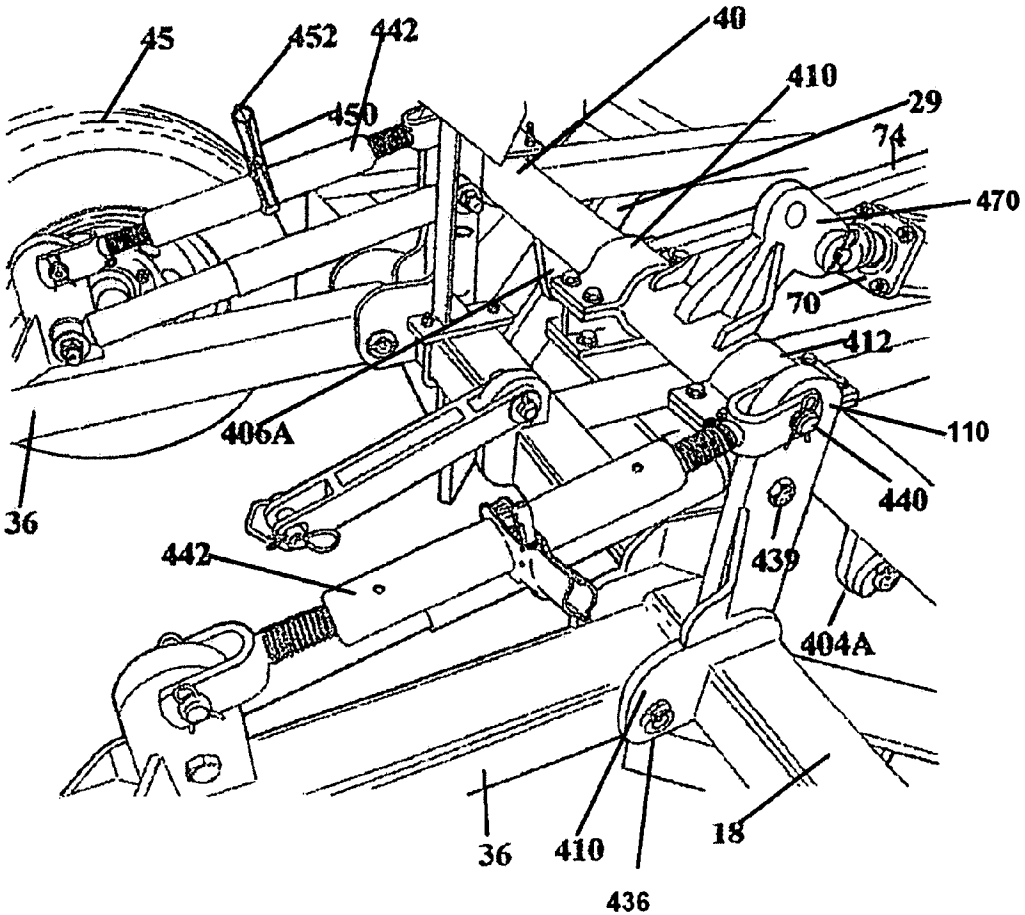
FIG. 5 is a partial view of the rear section of the road drag.

FIG. 5 shows detail of the axle 40 and tailboard 35 mounting. Arms 74 are pivotably attached to axle 40 by brackets 404A and 406A respectfully. The longitudinal motion of arms 74 is translated into rotational motion of the axle 40 within mountings 410 and 412 which are attached to platform 20. Brackets 410 are attached to tube 18 and provide pivot mounting points 436 for arms 36, and mounting point 439 for shock absorber 39 and 440 for turnbuckle 442. Turnbuckle 442 includes a ratchet mechanism 450 that can quickly tighten and loosen the turnbuckle connection which tends to raise and lower the tail board 35 by inserting a bar (not shown) into the ratchet hole 452 and rotating the turnbuckle 442. The cylinder 70 is also attached to the axle 40 by bracket 470. The cylinder 70 rotates the axle 40 in opposition to the cylinder 50 to provide a smooth non-binding motion of the axle 40.

Figure 6:
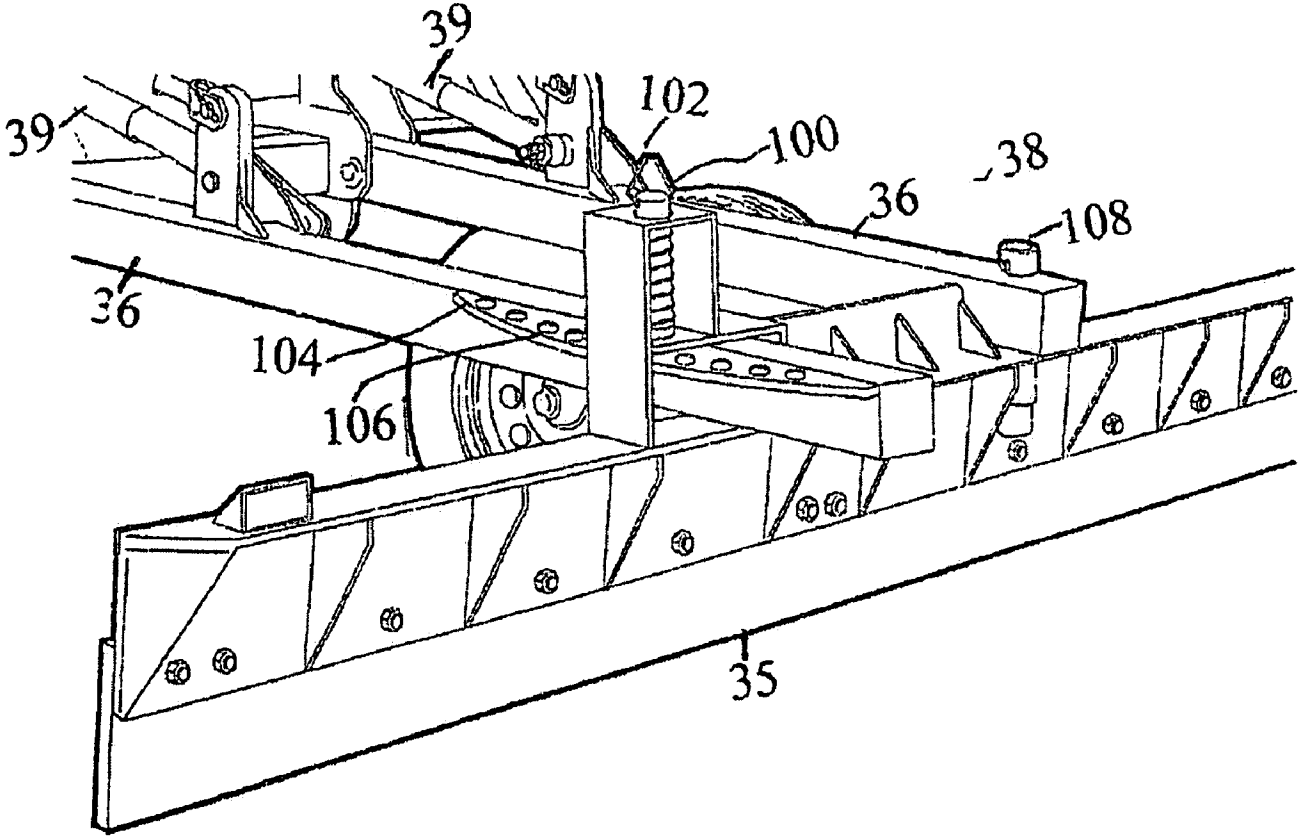
FIG. 6 is a partial view showing the tail board of the road drag.

In FIG. 6, shows the rear section 38 preferably includes means such as shocks 39 to prevent the tail board 35 from bouncing or hopping during application in order to better distribute material during use. In the preferred embodiment the means 39 is at least one shock absorber known in the art attached to the extensions 36 and the platform 20. The angle of the tail board 35 relative to the direction of travel "T" of the platform 20 can be adjusted using adjustment 100 which can include a spring loaded pin 102 and a plate 104 and a plurality of holes 106. The pin 102 can be pulled up and the position of the tail board 35 can be adjusted on pivot pin 108 until a desired angle and the pin 102 can be allowed to drop into the nearest hole 106. The tailboard 35 can be adjusted to move material to the right or left of the platform 20 as the platform 20 moves.

In operation, the design and configuration of the steel blades 29 described is to pull material in during application and then move the material out, and then pull the material back in, and then leveling. In the preferred embodiment, the front or first row of steel blades (blades 29 attached to the first arms 26 adjacent the front transverse bar 16 of the road drag 10) are disposed at an approximate 45 degree angle "B" with an approximate twenty inch clearance between the first row of steel blades 29 and the center or second row of steel blades (blades 29 attached to the ends 30A, 30B). The second row of steel blades 29 are disposed at an approximate 45 degree angle "C" with an approximate twenty-four inch clearance between the second row of steel blades 29 and the third row of steel blades (blades 29 attached to the arms 26 adjacent the rear transverse bar 18). The third row of steel blades 29 are disposed at an approximate 47 degree angle "D'" with an approximate five foot distance between the third row of steel blades 29 and a fourth row 29 disposed at a tail board 35 of the road drag 10. The fourth row of steel blades 29 can be selectively positioned during application. The details of the frame 20 and of the angles A, A2, B, C and D can be seen in FIG. 2.

The tail board 35 angle of attack can be adjusted from being perpendicular to the direction of travel of the road drag 10 to an angle where one end of the tail board 35 is ahead of the other such that the tail board 35 will tend to move material to one side of the road drag 10. Once the angle of the tail board 35 is set, cylinder 70 can allow the platform 20 to lower until the blades 29 and 35 touch the ground. Then dragging the road drag 10 in a forward direction, material is first directed inward by blades 29 mounted to arms 26; material is then directed back outward by blades 29 mounted to arms 30A and 30B; material is then directed back inwardly by blades 29 on arms 28 and finally material is spread in an adjustable manner by the tail board 35. As bumps are encountered the tail board 35, which is mounted to arms 36, which in turn are pivotably mounted to the rear bar 18, is held down to the ground by turnbuckles 442.

Although the description above contains many specificities, these should not be construed as limiting the scope of the invention but as merely providing illustrations of some of the presently preferred embodiments of this invention.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A road drag comprising:

a pair of side members connected by front, center and rear transverse bars that define a rectangular-shaped platform, a V-member disposed adjacent each front corner of the platform, said V-member having a first arm defining a 90 degree angle in relation to a support, second arms attached to a rear portion of said platform to said rear traverse board, steel blades attached to each of the first and second arms, said steel blades positioned in a downward direction, a center V-member attached to said center bar, wherein steel blades are attached to ends of said center V-member in a downward direction, a tail board secured to a pair of pivotably mounted extensions that extend from said rear bar of the platform defining a rear section, a shock absorber and adjustable turnbuckle connected at a first end to said platform and at a second end to said extension to control the position of said tail board and to prevent the tail board from bouncing during application, an axle and wheels adjacent the tail board, a front end that extends from the front bar of the platform with attaching means that is hitched to the back of a vehicle, and leveling means to raise and lower the platform for transport and work applications.

2. The road drag as recited in claim 1, wherein said blades on said first arm are angled to move material toward the center of the platform and said blades on said second arm moves material away from the center of said platform and wherein said leveling means includes a first cylinder acting to raise said platform on a pair of wheels and wherein a second cylinder acts to oppose said first cylinder.

3. The road drag as recited in claim 1, wherein said tail board is adjustably mounted such that an angle of said tail board can be adjusted and then locked in place such that said tail board will tend to move material to one side of said road drag as it is dragged forward.

4. The road drag as recited in claim 1, wherein said first arm has a smaller angle compared to a line perpendicular to a path of travel of said road drag than said second arm.

5. The road drag as recited in claim 1, wherein said first arm is at an angle of approximately 45 degrees to a line perpendicular to travel of said road drag and said second arm has an angle of approximately 47 degrees to said line perpendicular.

6. A road drag comprising:

a rectangular-shaped platform, a V-member disposed adjacent each front corner of the platform, said V-member having a first arm defining a 90 degree angle in relation to a support, second arms attached to a rear portion of said platform to said rear traverse bar, steel blades attached to each of the first and second arms, said steel blades positioned in a downward direction, a center V-member attached to said center bar, wherein steel blades are attached to ends of said center V-member in a downward direction, a tail board secured to a pair of extensions that extend from a rear bar of the platform defining a rear section, shocks and adjustable connections connected at a first end to said platform and at a second end to said extensions to control the position of said tail board and to prevent the tail board from bouncing during application, an axle and wheels adjacent the tail board, a hitch that extends from a front bar of the platform, and a cylinder to raise the platform for transport and lower the platform for work applications.

7. The road drag as recited in claim 6, wherein said blades on said first arm are angled to move material toward the center of the platform and said blade on said second arm moves material away from the center of said platform and wherein said cylinder to raise the platform includes a second cylinder that acts to oppose said cylinder.

8. The road drag as recited in claim 7, wherein said tail board is adjustably mounted such that an angle of said tail board can be adjusted and then locked in place such that said tail board will tend to move material to one side of said road drag as it is dragged forward.

9. The road drag as recited in claim 8, wherein said first arm has a smaller angle compared to a line perpendicular to a path of travel of said road drag than said second arm.

10. The road drag as recited in claim 8, wherein said first arm is at an angle of approximately 45 degrees to a line perpendicular to travel of said road drag and said second arm has an angle of approximately 47 degrees to said line perpendicular.

11. The road drag as recited in claim 10, wherein said cylinder includes a scale to indicate a depth of said blades.

12. The road drag as recited in claim 10, wherein said tail board extensions are pivotably mounted and include a ratchet adjustment to adjust the depth of said tail board.

13. A road drag comprising:

a platform, a member disposed adjacent each front corner of the platform, said member having a first arm defining a 90 degree angle in relation to a support, second arms attached to a rear portion of said platform to said rear traverse bar, steel blades aligned with and attached to each of the first and second arms, said steel blades positioned in a downward direction, a center V-member attached to said center bar, wherein steel blades are attached to ends of said center V-member in a downward direction, a tail board secured to a pair of extensions that extend from a rear bar of the platform defining a rear section, shocks and at least one adjustable connection connected at a first end to said platform and at a second end to said extensions to control the position of said tail board and to prevent the tail board from bouncing during application, an axle and wheels adjacent the tail board, a hitch that extends from a front bar to the platform, and a first cylinder to raise the platform for transport and lower the platform for work applications.

14. The road drag as recited in claim 13, wherein said tail board is adjustably mounted such that an angle of said tail board can be adjusted and then locked in place such that said tail board will tend to move material to one side of said road drag as it is dragged forward.

15. The road drag as recited in claim 13, wherein the first arm has a smaller angle compared to a line perpendicular to a path of travel of said road drag than said second arm.

16. The road drag as recited in claim 13, wherein said first cylinder includes a scale to indicate a depth of said blades, wherein said scale is visible to an operator towing said road drag and a second cylinder acts to oppose said first cylinder to provide smooth motion.

17. The road drag as recited in claim 13, wherein tail board extensions are pivotably mounted and include a ratchet adjustment to adjust the depth of said tail board.

18. The road drag as recited in claim 13, wherein said first arm is at an angle of approximately 45 degrees to a line perpendicular to travel of said road drag and said second arm has an angle of approximately 47 degrees to said line perpendicular.

19. The road drag as recited in claim 13, wherein said road drag includes an electrical connection to a towing vehicle and lights.

* * * * *